US009146054B2

(12) United States Patent
Moezidis et al.

(10) Patent No.: US 9,146,054 B2
(45) Date of Patent: Sep. 29, 2015

(54) REFRIGERATOR DOOR WINE DISPENSER

(75) Inventors: Nick Moezidis, San Jose, CA (US); Morris Taradalsky, San Jose, CA (US); Ross Rittiman, Zephyr Cove, NV (US); Jeffrey Brooks, San Jose, CA (US)

(73) Assignee: Napa Technology, Campbell, CA (US)

( * ) Notice: Subject to any disclaimer, the term of this patent is extended or adjusted under 35 U.S.C. 154(b) by 497 days.

(21) Appl. No.: 13/241,053

(22) Filed: Sep. 22, 2011

(65) Prior Publication Data

US 2012/0080445 A1 Apr. 5, 2012

Related U.S. Application Data

(60) Provisional application No. 61/385,624, filed on Sep. 23, 2010.

(51) Int. Cl.

| | |
|---|---|
| ***B67D 7/80*** | (2010.01) |
| ***F25D 31/00*** | (2006.01) |
| ***F25D 23/12*** | (2006.01) |

(52) U.S. Cl.

CPC ..... *F25D 31/007* (2013.01); *F25D 23/12* (2013.01); *F25D 2331/803* (2013.01)

(58) Field of Classification Search

CPC ..... B67D 7/74; B65D 83/00; B67B 1/00; F25D 3/00

USPC ..... 62/389–390; 222/153.03–153.04, 222/154–159, 204, 335, 399, 400.7, 545, 222/129.1, 146.6; 141/360, 372

See application file for complete search history.

(56) References Cited

U.S. PATENT DOCUMENTS

| | | | | |
|---|---|---|---|---|
| 2,414,047 | A * | 1/1947 | Lantieri | 285/197 |
| 2,880,971 | A * | 4/1959 | Coning | 165/263 |
| 3,232,489 | A * | 2/1966 | Buffington | 222/108 |
| 3,599,833 | A * | 8/1971 | Reichenberger | 222/23 |
| 3,685,692 | A * | 8/1972 | Erne et al. | 222/23 |
| 3,688,947 | A * | 9/1972 | Reichenberger | 222/27 |
| 4,836,414 | A * | 6/1989 | Credle et al. | 222/1 |
| 4,932,561 | A * | 6/1990 | Boxall | 222/54 |
| 5,165,575 | A * | 11/1992 | Scott | 222/129.1 |
| 5,791,517 | A * | 8/1998 | Avital | 222/1 |
| 6,422,422 | B1 * | 7/2002 | Forbes | 222/66 |
| 6,913,167 | B2 * | 7/2005 | Phelps et al. | 222/152 |
| 7,114,634 | B2 * | 10/2006 | Azodi | 222/81 |
| 7,712,631 | B2 | 5/2010 | Taradalsky et al. | |
| 2008/0251536 | A1 * | 10/2008 | Wong | 222/146.6 |
| 2010/0132831 | A1 * | 6/2010 | Waroux et al. | 141/66 |

* cited by examiner

*Primary Examiner* — Paul R Durand
*Assistant Examiner* — Andrew P Bainbridge
(74) *Attorney, Agent, or Firm* — Thomas Schneck

(57) ABSTRACT

A refrigerator having a door that includes a liquid dispensing system. A gas cylinder mounted on the refrigerator provides regulated gas flow to ports on the dispensing system. A bottle with a dispense head attached then can have liquid displaced by utilization of a valve component of the dispense head.

7 Claims, 8 Drawing Sheets

*Fig. 5* *(Prior Art)*

*Fig. 6* *(Prior Art)*

REFRIGERATOR DOOR WINE DISPENSER

CROSS-REFERENCE TO RELATED APPLICATION

This application claims priority from provisional application Ser. No. 61/385,624 filed Sep. 23, 2010.

TECHNICAL FIELD

The present invention relates to refrigerators, and more specifically to beverage dispensers incorporated as part of a refrigerator door.

BACKGROUND

Currently, refrigerators are increasingly incorporating devices to provide added functionality to users. For example, refrigerator or freezer doors now may be found with lights, ice and water dispensers, access hatches to allow quicker access to snack supplies, display screens, etc. There remains a strong motivation to provide increased functionality for home refrigerators.

One such functionality is beverage dispensers. For example, many consumers drink wine. Given that some wine can be quite expensive, users commonly take some care to make sure that the wine is properly stored. For example, if a bottle of wine is opened, the wine will react with the air, which can degrade the wine. Some devices are currently in use to preserve wine after a bottle has been opened. Such devices commonly displace the air within the bottle with a gas (for example, Nitrogen) that will not react with the wine or alter the taste of the wine. Beverage dispensers have been developed that can both ensure that the wine is stored such that the wine does not react and degrade, and allow the wine to be dispensed. For example, Napa Technology (Santa Clara, Calif.) makes a wine dispensing machine sold under the name WINESTATION®. This system is described in U.S. Pat. No. 7,712,631 which is hereby incorporated by reference for all purposes herein. This system allows preservation of the wine to minimize degradation of the wine, and allows a controlled dispensing of selected quantities of wine.

It is an object of the invention to provide a refrigerator with wine dispensing functionality.

SUMMARY

The above and other objects are achieved with a wine dispenser mounted on a refrigerator door. The refrigerator has a hinged or otherwise pivotably opened door. Mounted on this door is an in-door liquid dispenser. A dispenser door defines an interior compartment at which is mounted a dock. The docks may be accessible through a second door. The docks have a gas port that allows a gas input to be mated with a dispense head mounted on a liquid holding container. A gas (preferably a displacing gas that does not react with wine) from a gas cylinder mounted on said refrigerator, connected by a gas conduit, supplies gas to the dispense head. When an actuator is pushed, a valve opens to allow gas flow from the cylinder to the port through the conduit, allowing displacement of a volume of liquid.

In some embodiments the door to the beverage dispenser door includes a window allowing viewing of bottles contained within the beverage dispenser interior compartment, or a vent allowing the interior compartment of the dispenser to be kept at room temperature. The dispenser may also have a vent within the interior compartment to the interior of the refrigerator, to allow a liquid to be dispensed to be chilled. The cylinder could be mounted in the door of the refrigerator or below the refrigerator, in which case the gas conduit may be positioned at the hinge of the door.

The dispenser may also include a security device having pour and no pour settings. Such a device may be a keyed lock (with a mechanical or electronic mechanism for locking liquid dispensing), an electronic control (such as a code programmed into the actuator electronics) or other security means. The device may have one bay for holding a single liquid container, or two or more bays each having one dock, one gas port, and one control. The objects can also be realized with a method utilizing this device.

DETAILED DESCRIPTION

The dispense head disclosed in U.S. Pat. No. 7,712,613 and shown in FIGS. 4-8 of this reference provides a number of unique features. First, the dispense head is affixed onto a wine bottle, but the dispense head is not permanently a part of the liquid dispensing device. Instead, the dispense head includes a stopper that inserts into the top of a wine bottle. This dispense head includes a gas receiving input port, a valve system for control of the gas flow, a pour spout, and a tube extending into the wine bottle. A stream of gas from the input port can be introduced into the wine bottle when the valve is properly aligned. This displaces a controlled amount of wine from the bottle. Following the pour function, the gas from the inlet can be directed to the spout, creating a "puff" of gas, which clears the wine from the spout. When the valve is rotated such that the gas source does not align with the down tube or the spout, the wine bottle is effectively sealed. Thus the dispense head allows this sealed bottle to be removed from the dock of the dispense system without air being introduced into the wine. The dispense gas is selected to not degrade wine (e.g. nitrogen).

When the wine is dispensed, a stream of gas (such as nitrogen) will displace a specific quantity of wine. A user or pourer may then select the specific amount of wine poured (e.g. a one ounce taste, and four ounce half glass or an eight ounce full glass). The regulation of the gas flow will control the amount of wine dispensed.

Figure 1:
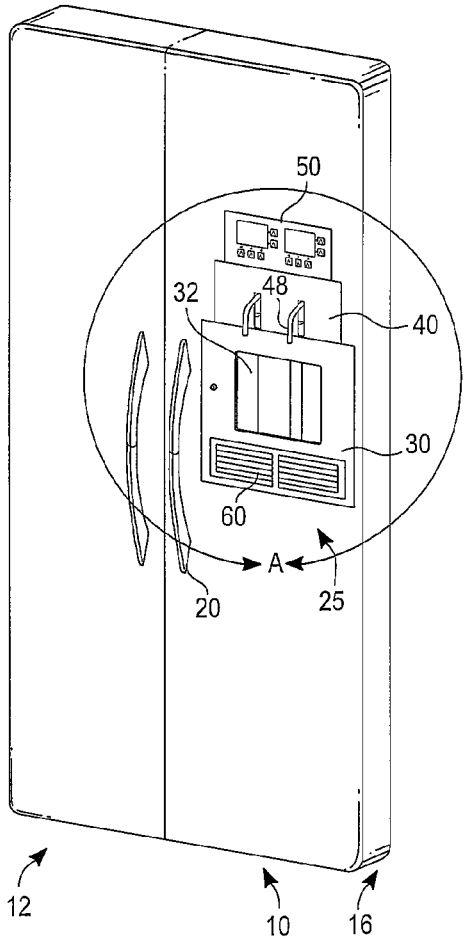
FIG. 1 is a front perspective view of a refrigerator/freezer door pair, with a wine dispenser on the refrigerator door.
Figure 1A:
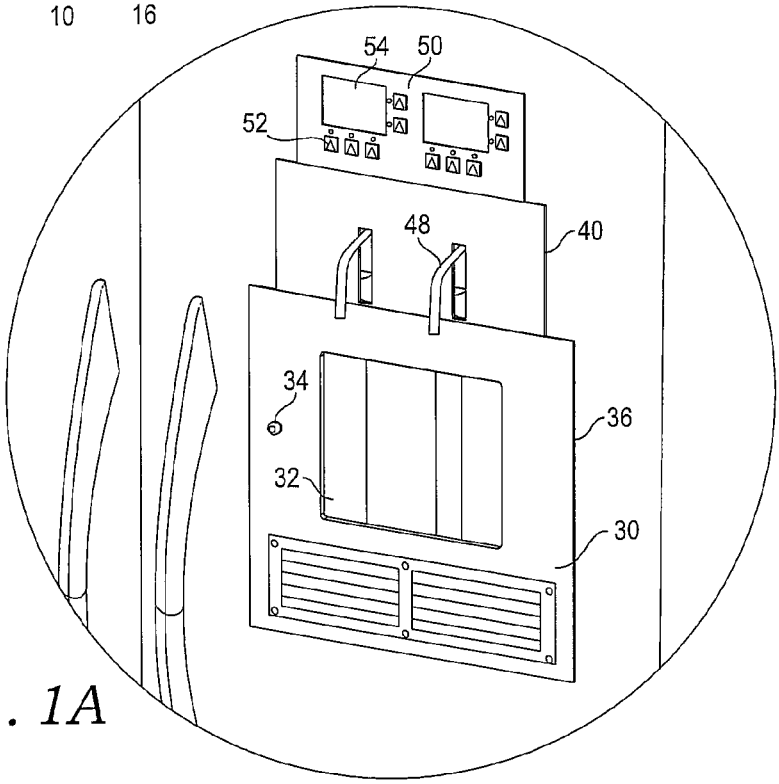
FIG. 1A is a detail of FIG. 1 showing a detail along arrow A, showing the wine dispenser.

With reference to FIGS. 1 and 1A, a wine or liquid dispensing system on a refrigerator door is shown. This is on a side by side refrigerator/freezer, which include a refrigerator door 10, and a freezer door 12. The present system could also be adapted to top or bottom freezer configurations. A water and ice dispenser may still be included with the refrigerator, for example on the freezer door. The refrigerator door includes a door handle 20 and a hinge 16. Mounted on the refrigerator door is a wine dispenser 25. The wine bottles may be introduced by opening wine door 30. A window 32 on wine door 30 allows the wine label to be viewed. A lock 34 on wine door 30 allows the wine door 30 to be secured.

Above wine door 30 is a hatch 40. This may swing out (as seen in FIG. 1A) or up. This hatch allows access to the dispense heads, including the spout 48 that extends from the dispense heads.

A display panel 50 includes display screens 54. These may be touch screens, eliminating the need for separate buttons. Alternatively buttons 52 may be used.

As in the prior device, the wine may be temperature controlled. The wine bay in which the wine bottles are housed may be a single space, or may be separated into two compartments. If the area is separated into two compartments, one or both compartments can be kept cooled. A simple way to do this is to have the wall of the compartment that is facing the interior of the refrigerator have vents (such as vents 260 shown in FIG. 2), which may be opened. Opening these vents would keep the compartment at the temperature of the refrigerator interior. In addition, closing the internal vents and opening vents on the front of the door of the refrigerator (such as vents 60 shown in FIG. 1) would expose the bottles to the room temperature.

Figure 2:
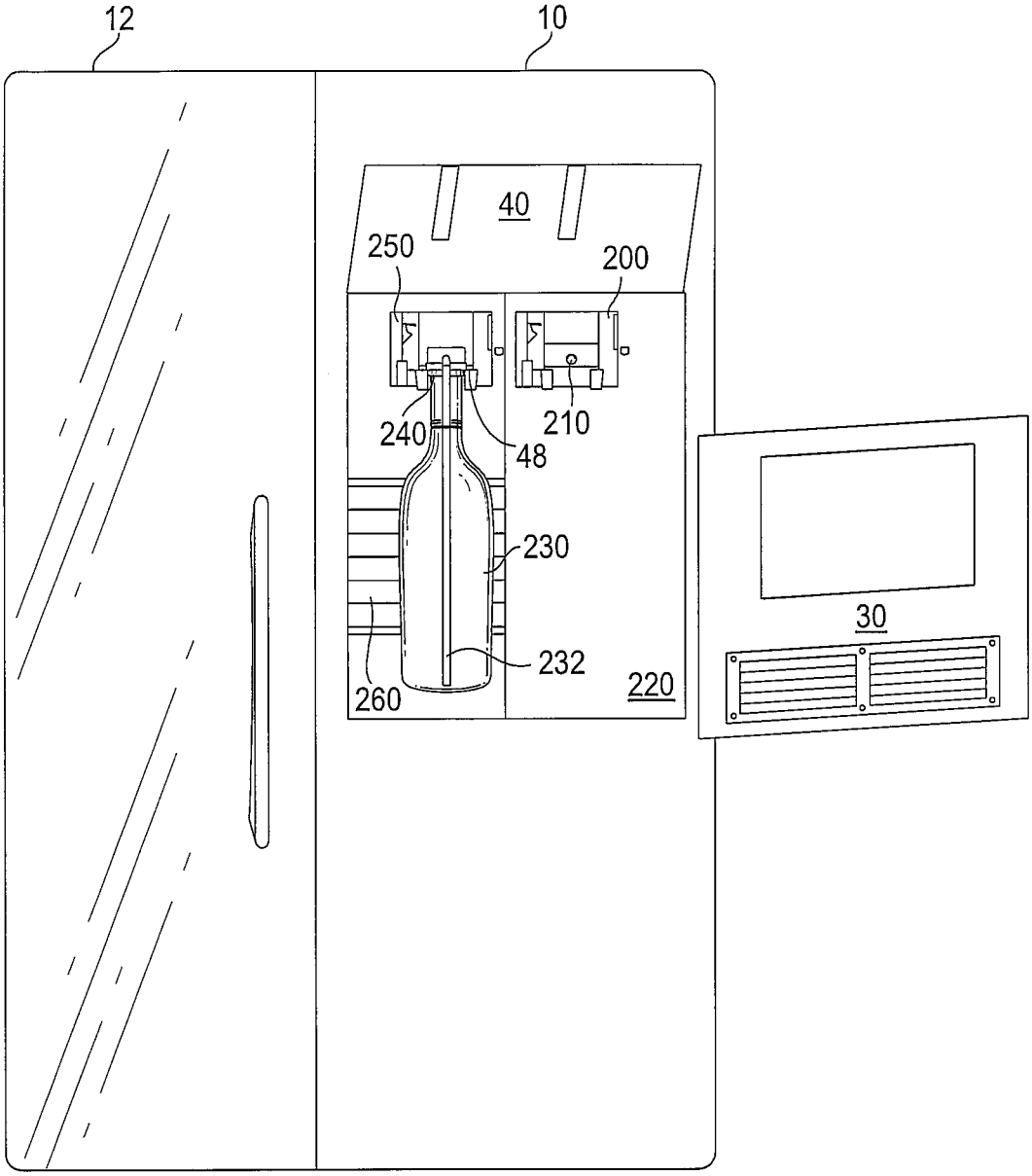
FIG. 2 is a front view of a refrigerator/freezer door pair with a wine dispenser on the refrigerator door, and the wine bottle insertion door open.

With reference to FIG. 2, the wine dispensing device is shown with the wine door 30 and the spout panel 40 open. The spout 48 is shown on the dispense head stopper 240 includes a tube 232 that extends into the wine bottle 230. A dock 200 is also shown without a wine bottle inserted into the dock. The gas input port 210 allows the gas inlet on the dispense head to mate with the input port. These seal together when the dispense head is in the dock.

Figure 3:
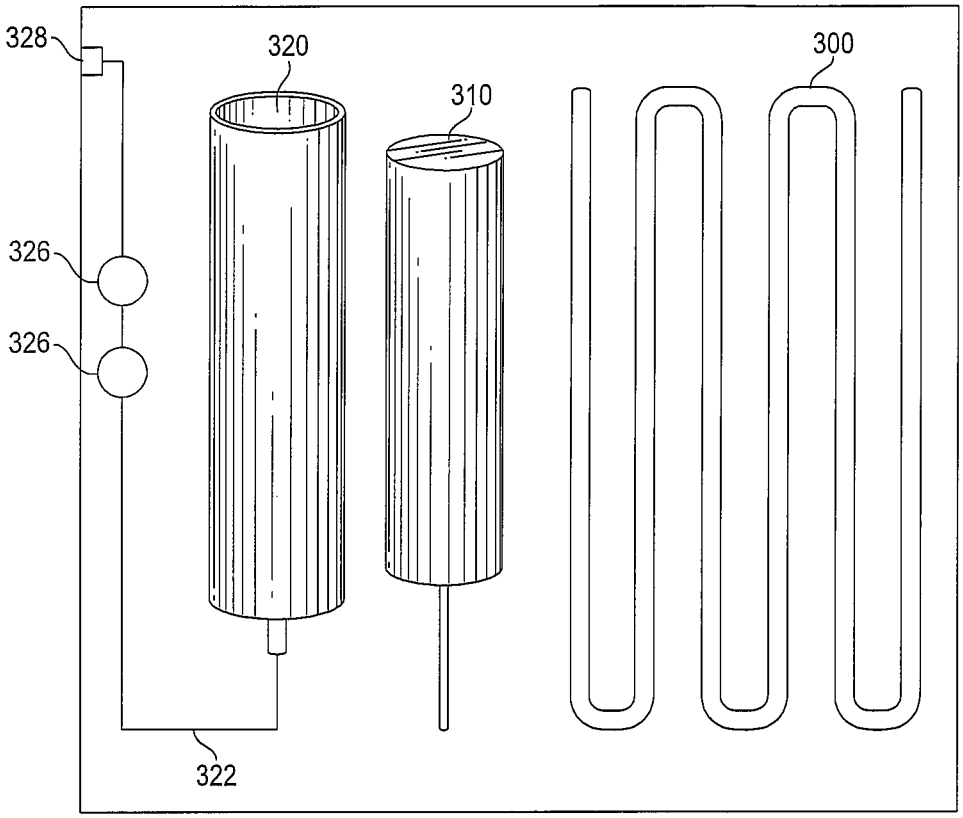
FIG. 3 is a bottom view of a refrigerator showing positioning of the gas cylinder.

With reference to FIG. 3, the underside of a refrigerator shows coils for cooling the interior of the refrigerator, and a water filter 310, to allow filtered water to be dispensed from the refrigerator and to supply an ice maker. The system also includes a gas cylinder 320 to supply the wine dispenser. The gas cylinder can be coupled at the bottom of the refrigerator. A gas line 322 allows the gas to flow from the cylinder 320 through a regulator 324 and pressure gauge/valve 326 that controls the flow of gas. The gas then flows to an output line 328.

Figure 4:
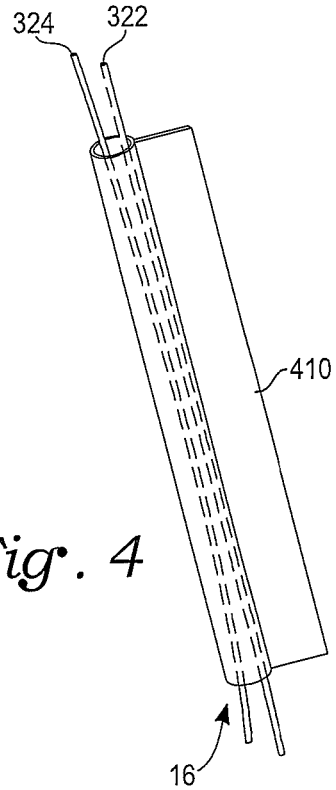
FIG. 4 is a cross sectional view of the hinge of a refrigerator door, the hinge containing the gas line.

The output line, in one embodiment, can extend through the hinge of the refrigerator to supply gas to the wine dispenser, as illustrated in FIG. 4. At the hinge a magnetic seal 410 allows the refrigerator door to be securely shut. The hinge 16 may include a tube on which the door moves. Within the tube a wire 322 may allow power and data to be sent to the wine dispenser. In addition, a gas line 324 may be placed in the hinge tube to provide the gas to the wine dispensing system.

There are a number of possible iterations of this device. For example, the wine could be inserted from the front of the refrigerator as shown. However it is also possible that the wine dispenser could be configured that the wine bottle with dispense stopper clips into contact with a gas inlet that is above or to the side of the bottle. Such a configuration would allow the wine bottle to be inserted from the back of the refrigerator door. The wine bottles may be held in an area, like a shelf, that is open in the back. Such a dispenser would be limited to chilled wines only. Alternatively, the wine could be held in a vented compartment insulated from the interior of the refrigerator. This would be for non-chilled wine. This is shown in FIG. 1.

It may be desired to have some type of security on this device. Given that some wine is quite expensive, it is important that wine not be spilled or inadvertently dispensed. In addition, some refrigerator owners may be concerned that children or underage drinkers will access the wine. To address these concerns, a security device may be added to the refrigerator door wine dispenser. This device may include:

1. Use of the buttons on the wine dispenser shown in FIGS. 1 and 2. These could require a user to press the buttons in a specified sequence before wine is poured. Such "unlock" mechanisms can be found currently on cell phones. For example, two buttons might have to be pressed at the same time to generate a screen prompt. The screen would prompt a user to press an additional button before pouring is allowed.

2. Key entry. The device of FIGS. 1, 1A and 2 show a wine entry door that is lockable with a key. This lock could be designed to have three positions: open, locked, and pour. In the open position, the lock mechanism would disengage, the door could be opened and wine bottles inserted. In the locked position (a quarter turn from open), the door would be locked and the wine dispenser would not dispense wine. In the pour position (a further quarter turn of the key from the locked position) the door would remain locked and the dispenser would be activated to allow wine to be dispensed.

3. Card access. As shown in U.S. Pat. No. 7,712,631, which is incorporated by reference in this document, a card reader may be used with a wine dispenser. A card would be required to be placed in the slot to pour the wine.

4. Wireless. Wireless devices, such as Bluetooth, RFID or other technologies are increasingly ubiquitous. In one embodiment, a card, key or other device could be read without contact with the dispenser. This device would unlock the system and allow pouring.

5. Biometric security. Currently, off-the-shelf components are available for fingerprint scanning. This technology is currently in use for company entry badge scanners/printers so that the identity of guests can later be confirmed. These scanners are low power and could be powered using the power source shown in the Figures. Other biometric security (e.g. retinal) are also known.

6. Voice or image recognition. This security technology is also commercially available. Incorporating it into a wine machine would provide added security.

Figure 5:
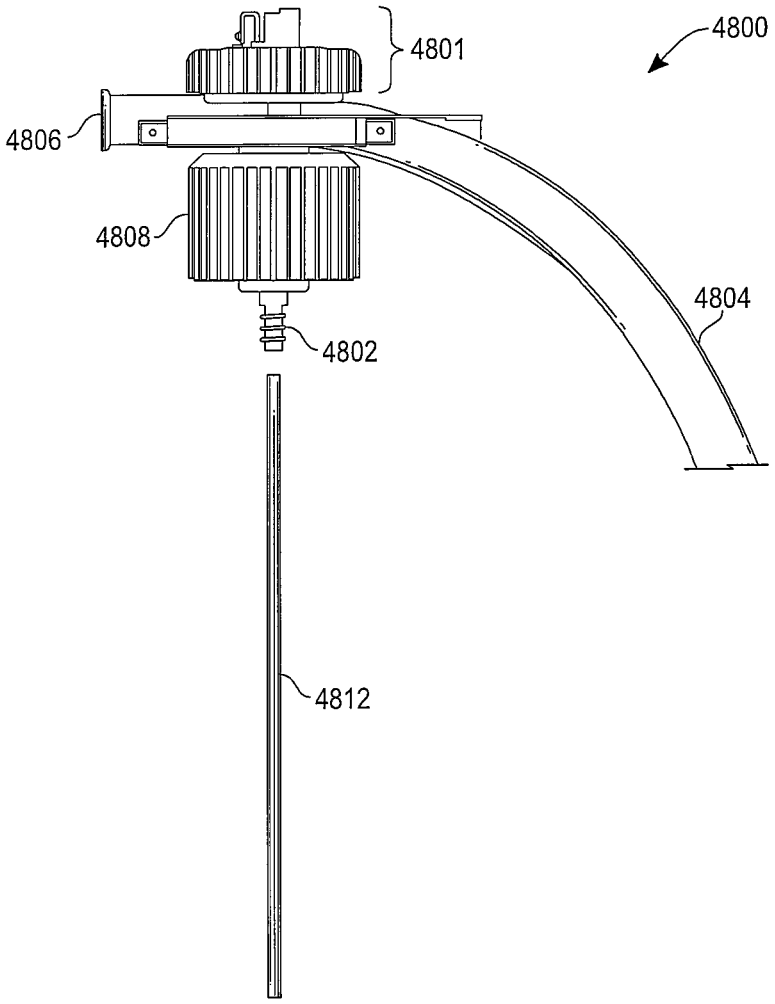
FIG. 5 is a side view of the dispensing head.

With reference to FIG. 5, the dispense head 4800 is shown having a gas input 4806 and dispense spout 4804. In the illustrated embodiment, dispense spout 4804 is located on an opposite side of gas input 4806. Gas input 4806 can mate with a gas supply outlet on the dispense machine in a gas-tight fitting thereby ensuring gas availability for dispensing of the wine without gas loss. A tube mount 4802 allows mounting of a liquid intake tube 4812 to the dispense head. The tube should be sterile and have a length suitable for the bottle onto which the dispense head is mounted. A cap 4808 is designed such that when tube 4812 is inserted into the bottle, cap 4808 extends over the top of the bottle. In this illustrated embodiment, gas input 4806 is located opposite dispense spout 4804. Thus when this dispense head is placed over a bottle and the bottle installed in a dispensing machine the gas input 4806 faces the interior of the stall to mate with a gas supply source and the dispense spout faces out of the stall to allow pouring into a user's glass. It would be apparent that the gas connection may be anywhere within the three sides of the stall. However, a back wall gas connection is simplest for bottle mounting and latching.

The top of the dispense head is a valve assembly 4801. This valve assembly allows the selective control of gas and liquid flow. The selective rotation of the valve assembly can for example allow purging of the liquid within the wine bottle, the displacement of controlled volumes of liquid from the bottle to the dispense spout 4808, or the cleaning of the dispense spout 4808 using a puff of gas.

Figure 6:
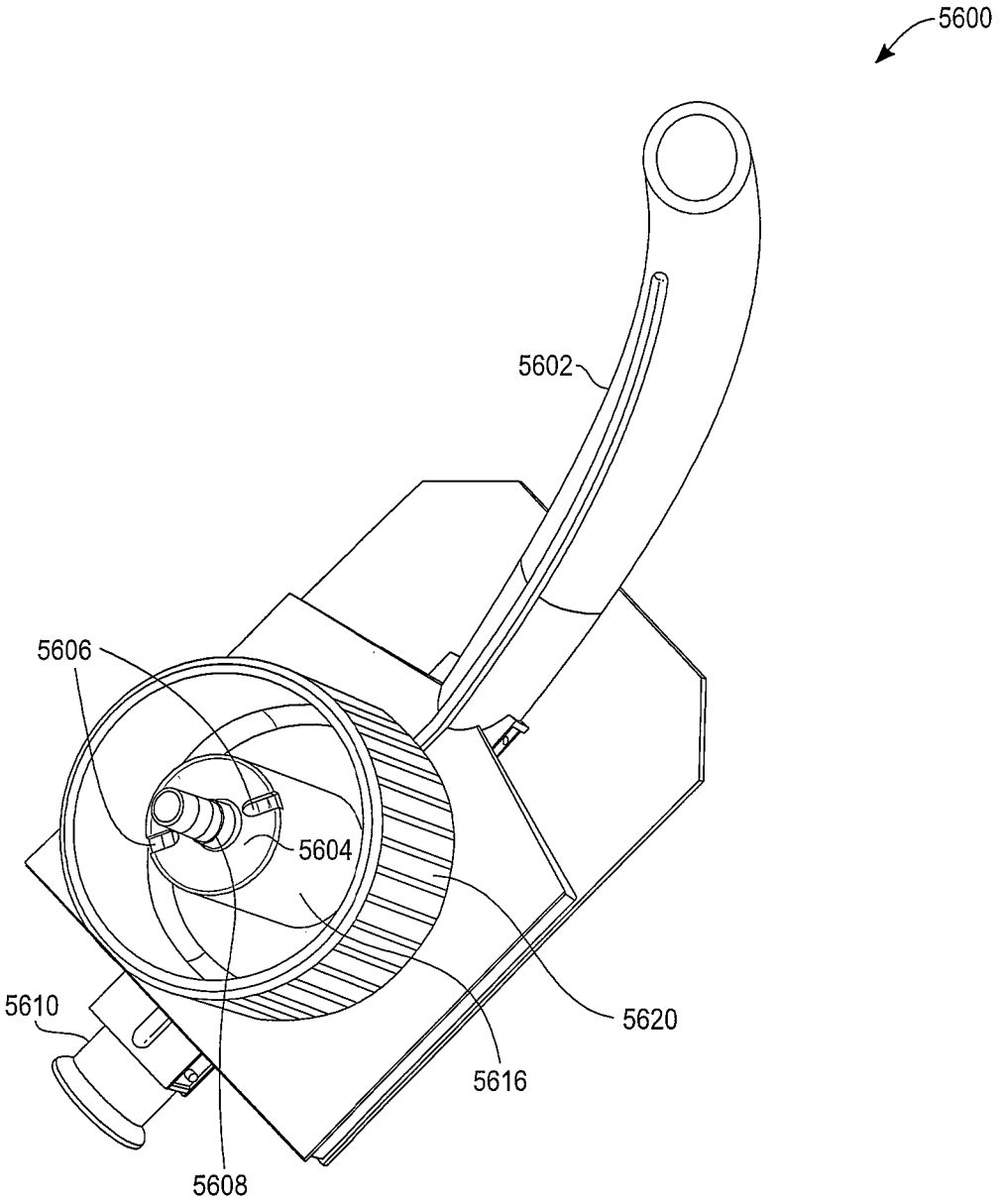
FIG. 6 is a bottom view of the dispensing head.

With reference to FIG. 6, the underside of the device shows the dispense spout 5602 and the gas intake 5610. The stopper 5604 is inserted in a bottle of wine and the cap 5620 is disposed about the neck of the bottle. The stopper may have a plurality of tapering ridges 5616 to allow a tighter fit into the neck of the bottle, and allows the stopper to be able to be used with some variation in bottle neck size. Gas ports 5606 allow introduction of the gas regulated by the valve into the bottle through the underside of stopper 5604. This gas is introduced at the top of the bottle. This is advantageous because the gas would form a head over the liquid without bubbling through the liquid or having the gas ports contact the liquid within the bottle.

Figure 7:
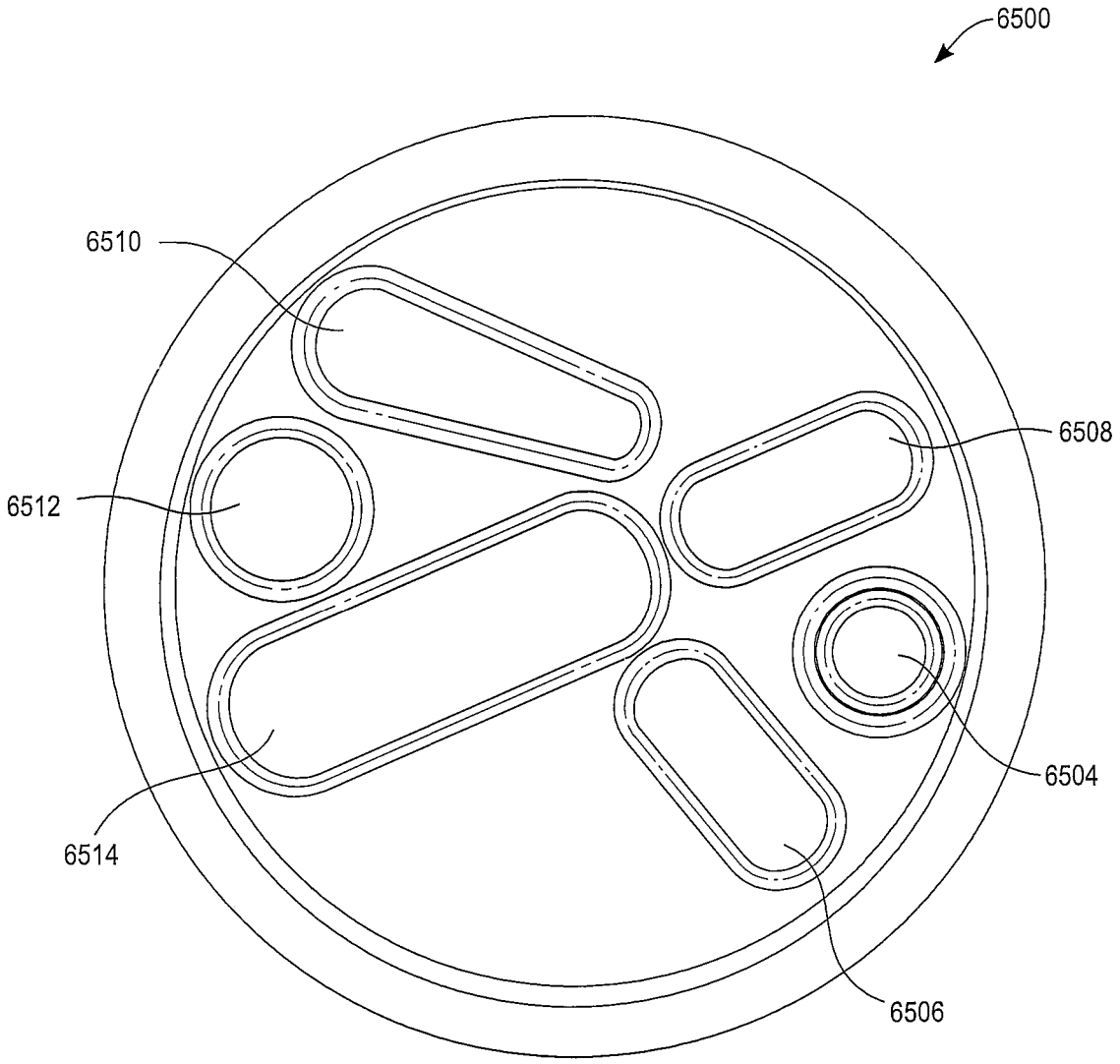
Fig. 7 (Prior Art)
FIG. 7 is a bottom perspective view of the dispensing head rotational valve.

The rotating valve 6402 is showing greater detail in FIG. 7. As can be seen on the underside of the rotating valve a plurality of pathways were molded into the rotating valve. It is inherent from FIGS. 4-8 that the positioning of these pathways and with the intake tube, stopper gas inlets, pour spout and gas intake (as illustrated) that the present rotation valve would allow retention onto a bottle, sealing of the bottle from gas inflow or outflow, gas driven liquid dispensing, a gas purge of gas from within a bottle, or a gas "puff" to clear a dispense spout. The pathways of the rotating spout may be aligned with the dispense spout, liquid intake tube, and gas input shown in FIGS. 4, 5, and 6. From this view of the various pathways the following function are inherently available.

1. Valve is rotated to block both the dispense spout and the gas intake. In FIG. 7, this would, for example, mean that recessed area 6504 is located over the gas inlet opening, and location 6512 is located over the spout opening. This affectively seals the bottle with the dispense head functioning as a cork and maintains the pressurization within the bottle. The bottle may then be removed from a dispense system and placed in storage. The dispense head is retained on the bottle by simple frictional resistance, the valve would remain its position unless moved by a motor. If the pressurized gas (such as an inert gas like argon or nitrogen within the bottle has been introduced into the bottle by the system the wine in the bottle will not oxidize and may be served at another date.

2. The valve may be rotated to allow gas injection through the intake tube and venting of gas through the stopper and dispense spout. In FIG. 7, this would, for example, be effected by rotation of the valve such that recessed area 6506 would provide a passageway for gas from the opening of the gas intake to flow into a first stopper gas inlet. A second recessed area 6510 would connect the second stopper gas inlet to the dispense spout. This would allow a replacement of the head of air in the bottle with the neutral gas provided by the system. The gas would flow from the gas source, into the bottle through a first stopper gas inlet, out the second stopper gas inlet and then be vented through the spout.

3. For dispensing, the valve would be rotated to allow gas flow through the stopper and liquid flow through the intake tube to the dispense spout. With reference to FIG. 7, this would be effected by aligning recessed area 6508 to connect the opening from the gas inlet to the stopper gas inlet. This would allow gas flow into the bottle, and allow fluid to be displaced. Recessed area 6514 would connect the intake tube top opening with the pour spout, providing for the displacement of a selected volume of liquid. The volume of the gas flowing into the system will determine the volume of liquid dispensed.

4. Alignment of the valve such that gas from the gas intake flows directly to the dispense spout bypassing the stopper. This would allow a brief puff of air to clear the remaining fluid in the line ensuring that the pour is at the proper volume and that the wine is not contaminated. This would be effected by the controlled rotation of the valve as per number 2 above. The valve configuration for "purging" the gas from bottle after opening would also allow for a "puff" to clear any residual liquid in the pour spout with a short puff of gas from the gas source.

The various features and functions of the dispense head are illustrated in FIGS. 5-7. The dispense head is uniquely characterized in having a stopper that is inserted into a wine bottle and allows regulation of the gas within the wine bottle. Thus such a dispense head once introduced into the wine bottle may remain attached to the wine bottle, both when the dispense head (with attached wine bottle) is placed within a dispensing machine and when the dispense head and wine bottle are removed from the dispense machine for storage elsewhere.

The gas within the wine bottle forming a head over the liquid is an inert gas provided by the dispensing machine. This is generally a neutral gas, such as argon or nitrogen, which will inhibit oxidation of the wine. This preservation and prevention of oxidation is advantageous in preventing the undesired degradation of the wine.

Figure 8:
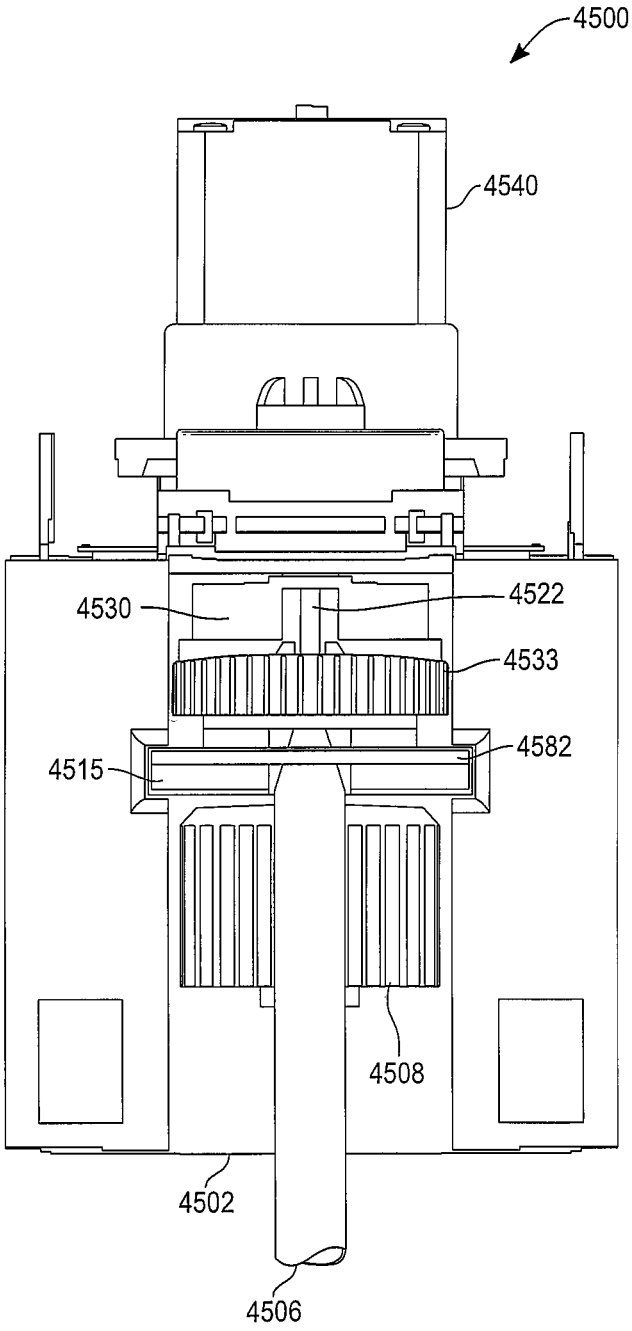
Fig. 8 (Prior Art)
FIG. 8 is a front view of the dispensing head and the motor for engaging the dispensing head.

With reference to FIG. 8, the dispense head 4502 includes a pour spout 4506 and a cap 4508. The dispense head 4502 has a body 4512 which fits into a slot 4582. On dispense head 4502 a rotating valve 4533 includes a drive tab 4522 that is engaged by a drive head 4530. This drive head 4530 is mechanically linked to stepper motor 4540. This allows selective control of the valve. It will also be realized that once drive head 4530 is rotated this configuration, along with the latch door, effectively precludes removal of the wine bottle providing multiple levels of security.

The present dispense head may be simply secured over a wine bottle. The dispense head is inserted into the wine bottle and dispensing is driven by gas from the system. However, the bottle and dispense head may be removed from the rest of the system quite easily and quickly. The flow from the bottle is driven by an inert gas such as argon or nitrogen.

The following features may be part of various basic embodiments of wine preservation: a refrigeration unit, automated wine preservation, automated pour control, wine transaction tracking, customer smartcard control, employee smart card control, unit management, LCD wine identification display, merchandising management, product/brand management, site location management, customer marketing management, inventory management, distributor/wholesaler management, auto-latch security, UPC/barcode database management, and wine rating management.

In one embodiment, the present invention provides a way that wine and other liquids can be dispensed at predefined volumes using a preserving gas. It also provides a system for capturing, presenting, managing, and reporting data and information related to dispensing liquids.

In one embodiment of the invention a dispensing head is used to dispense the liquid. In various embodiments of the dispensing head, it may be designed to have a variety of features. The dispensing head may be disposable, which eliminates the need for cleaning the dispensing unit. The dispensing head once inserted into the dispensing unit enables the purging of the initial air that is present in a bottle when it is first opened, by replacing this air with an inert gas such as nitrogen or argon. Once this purging is complete the dispensing head is sealed preventing air from reentering the bottle.

The bottle can then be served in predefined measured volumes by pressing a button on the dispensing unit. The button signals the unit to pour the desired volume by starting the flow of the inert gas into the bottle and displacing the desired liquid into a waiting glass at the dispensing head spout. The dispensing head, after it has poured the desired volume into the glass, performs a puff function using the inert gas to clear any liquid that remains in the dispensing head spout. After the initial purging of the original air in the bottle, the bottle can also be removed at any time from the dispensing unit and be stored for later use due to the dispensing head's ability to prevent air from reentering the bottle either through the gas intake or the dispense spout, hence preserving the liquid. The dispensing head also may have a built-in detection mechanism to ensure that the proper volume is being served. One such way to detect the volume is by detecting the liquid in the dispensing head spout by detecting a current through the liquid as it is pouring.

Figure 9:
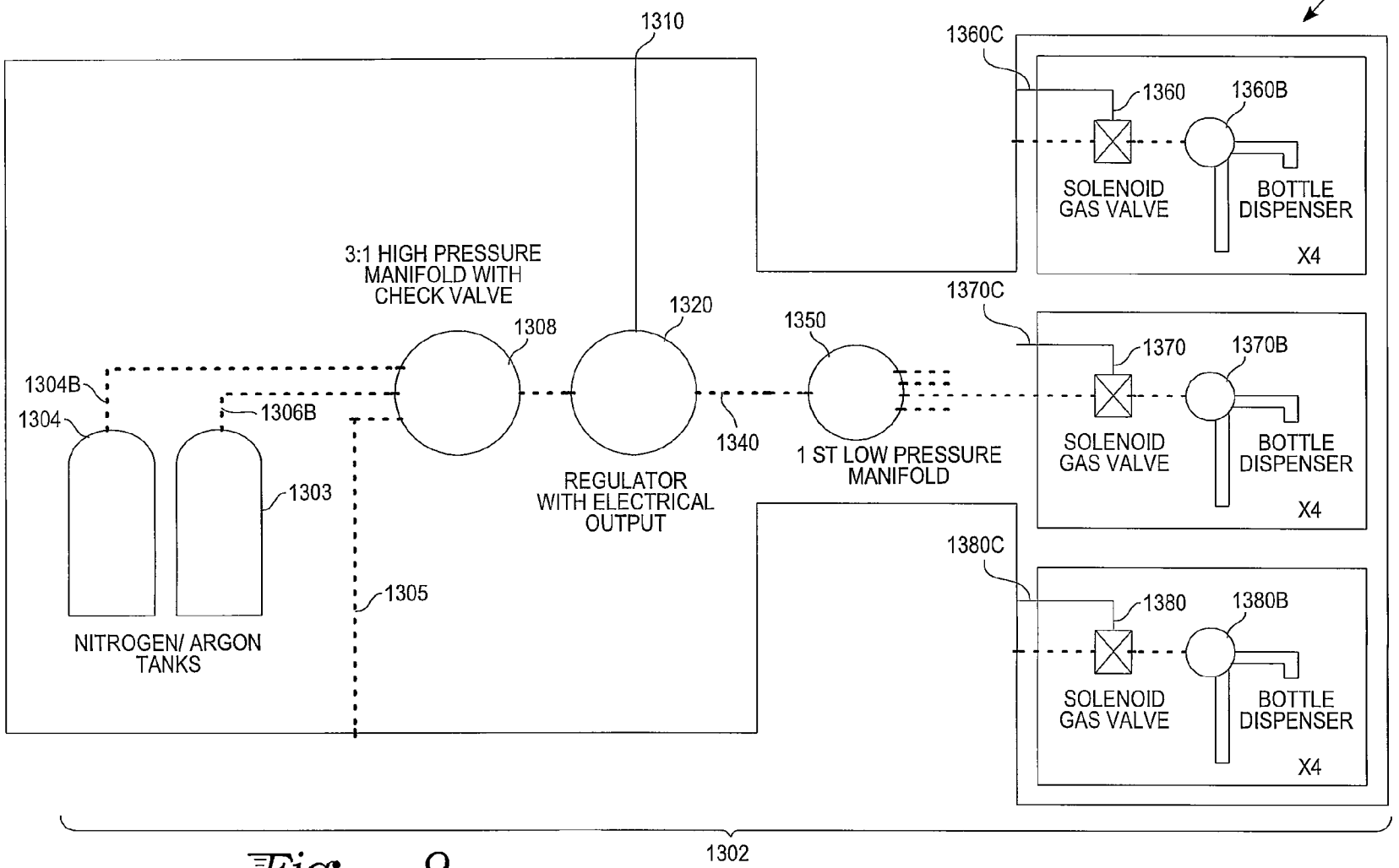
FIG. 9 is a schematic showing gas flow.

With reference to FIG. 9, gas tanks 1304, 1303 may provide the gas source. Alternatively gas line 1305 could allow connection to a gas source that is external to the device. A 3:1 high-pressure manifold with a check valve combines the gas from various sources into a single output line. The gas tanks 1304, 1303 are connected to this 3:1 high pressure manifold 1308 by gas lines 1304*b*, 1306*b*, respectively. The manifold 1308 feeds the high-pressure gas to a regulator 1320. The output regulator allows flow via the connection 1310 to the control system. It could also be linked to the indicator light or other indicator system showing gas pressure is low and requires maintenance. The gas passing through regulator 1320 is connected by line 1340 to 1:4 low-pressure manifold. This manifold 1350 divides the single gas source into 4 different lines supplying each of four stalls in the dispensing machine as shown in FIGS. 1 and 2. Each of the individual gas lines is connected to a solenoid 1360, 1370, 1380, which are electrically controlled by wires 1360*c*, 1370*c*, 1380*c*, respectively. If the solenoids are open, gas can flow to respective dispense heads 1360*b*, 1370*b*, 1380*b*. By controlling the opening of the solenoid and flow of gas, selected amounts of wine can be dispensed.

We claim:

1. A refrigerator comprising:

one or more pivotably openable refrigerator door configured to provide access to an interior, temperature regulated compartment;

an in-door liquid beverage dispenser including:

at least one beverage dispenser door mounted on said openable refrigerator door said dispenser door providing access to a beverage dispenser interior compartment in said refrigerator door;

wherein said beverage dispenser interior compartment is enclosed and sealed from the rest of the interior, temperature regulated compartment, and includes an openable vent in the rear of said beverage dispenser interior compartment, wherein opening said openable vent allows the said beverage dispenser interior compartment to be kept at a temperature of said interior, temperature regulated compartment;

a dock contained within said beverage dispenser interior compartment, said dock having at least one docking location configured to allow docking of a bottle mounted dispense head such that a bottle is suspended by the bottle mounted dispense head;

a gas cylinder mounted on said refrigerator;

a gas conduit positioned to allow gas flow from said gas cylinder to a gas port at said dock, said gas port providing gas flow to said dispense head to allow displacement dispensing of liquid from a bottle to which said dispense head is mounted; and at least one actuator on said refrigerator, wherein actuation of said actuator triggers regulated gas flow to dispense a selectable volume of liquid.

2. The device of claim 1, wherein said beverage dispenser door includes a window allowing viewing of bottles contained within the beverage dispenser interior compartment.

3. The device of claim 1, in which said gas cylinder is positioned on a retainer on an underside of the refrigerator and the gas conduit is included in a refrigerator door hinge, wherein said dispense head includes a gas intake port to receive gas delivered through said gas conduit, wherein said dispense head is further configured to confine dispensed liquid to said dispense head and associated bottle, thereby removing any need to have liquid pass through additional elements of the in-door liquid beverage dispenser.

4. The device of claim 1, further comprising a security device on said in-door liquid beverage dispenser configured to allow user regulation of beverage dispensing.

5. The device of claim 4, wherein said security device includes a key lock, said key lock having a locked position in which liquid is not dispensed and a pour position in which wine is dispensed.

6. The device of claim 4, wherein said security device includes an electronic control of a pour/no pour setting.

7. The device of claim 1, wherein the in-door liquid beverage dispenser includes at least two bays, each bay having one dock, one gas port, and one control such that each port can hold one bottle with attached dispense head and separately allow dispensing of liquid from each dispense head.

* * * * *